US009841777B2

(12) United States Patent
Enjalbert et al.

(10) Patent No.: US 9,841,777 B2
(45) Date of Patent: Dec. 12, 2017

(54) VOLTAGE REGULATOR, APPLICATION-SPECIFIC INTEGRATED CIRCUIT AND METHOD FOR PROVIDING A LOAD WITH A REGULATED VOLTAGE

(71) Applicants: Jerome Enjalbert, Fonsorbes (FR); Joachim Kruecken, Munich (DE); Jalal Ouaddah, Toulouse (FR)

(72) Inventors: Jerome Enjalbert, Fonsorbes (FR); Joachim Kruecken, Munich (DE); Jalal Ouaddah, Toulouse (FR)

(73) Assignee: NXP USA, Inc., Austin, TX (US)

( * ) Notice: Subject to any disclaimer, the term of this patent is extended or adjusted under 35 U.S.C. 154(b) by 26 days.

(21) Appl. No.: 14/888,956

(22) PCT Filed: May 29, 2013

(86) PCT No.: PCT/IB2013/001452

§ 371 (c)(1),
(2) Date: Nov. 4, 2015

(87) PCT Pub. No.: WO2014/191787

PCT Pub. Date: Dec. 4, 2014

(65) Prior Publication Data

US 2016/0098050 A1 Apr. 7, 2016

(51) Int. Cl.

| | |
|---|---|
| ***G05F 1/59*** | (2006.01) |
| ***G05F 1/56*** | (2006.01) |
| ***G05F 1/575*** | (2006.01) |
| ***G05F 1/565*** | (2006.01) |

(52) U.S. Cl.
CPC ..... *G05F 1/575* (2013.01); *G05F 1/56* (2013.01); *G05F 1/565* (2013.01)

(58) Field of Classification Search
CPC .... H02M 2001/0045; G05F 1/59; G05F 1/56; G05F 1/461; G05F 1/46
See application file for complete search history.

(56) References Cited

U.S. PATENT DOCUMENTS 5,512,814 A * 4/1996 Allman ..... G05F 3/262 323/267
6,639,778 B2 * 10/2003 Smith ..... G05F 1/613 361/104
6,894,465 B2 * 5/2005 Sutardja ..... H02M 1/088 323/268

(Continued)

FOREIGN PATENT DOCUMENTS

WO 2009085439 7/2009

OTHER PUBLICATIONS

International Search Report and Written Opinion correlating to PCT/IB2013/001452 dated Feb. 26, 2014.

*Primary Examiner* — Gary L Laxton

(57) ABSTRACT

A voltage regulator for digital loads combines a closed loop regulation circuit with an open loop topology. A transistor and a bank of transistors share the same voltage source VDD and gate control current. Each of the bank of transistors is sized to match different current load requirements and one or more may be switched in or out as appropriate when the digital load transitions from one operating mode to another. The regulator has good DC load regulation and unconditional stability regardless of output capacitance.

18 Claims, 3 Drawing Sheets

(56) References Cited

U.S. PATENT DOCUMENTS

| | | | | |
|---|---|---|---|---|
| 7,915,878 | B2 * | 3/2011 | Komori | H02M 3/1584 323/272 |
| 8,582,259 | B2 | 11/2013 | Murakami et al. | |
| 8,860,389 | B2 * | 10/2014 | Gakhar | G05F 1/563 323/271 |
| 2002/0130646 | A1 | 2/2002 | Zadeh et al. | |
| 2007/0159146 | A1 | 7/2007 | Mandal | |
| 2009/0121694 | A1 | 5/2009 | Wyatt | |
| 2012/0262137 | A1 | 10/2012 | Arigliano et al. | |
| 2013/0076325 | A1 | 3/2013 | Liu et al. | |

* cited by examiner

FIG. 1- PRIOR ART

VOLTAGE REGULATOR, APPLICATION-SPECIFIC INTEGRATED CIRCUIT AND METHOD FOR PROVIDING A LOAD WITH A REGULATED VOLTAGE

FIELD OF THE INVENTION

This invention relates to voltage regulators and has particular though not exclusive application to the provision of a regulated voltage to a digital circuit having varying load current requirements.

BACKGROUND OF THE INVENTION

Voltage regulators are commonly used in the power management systems of computers, mobile phones, automobiles and many other electronic products. Generally, voltage regulators are configured to convert an unstable power supply voltage into a stable one. A "low dropout" (LDO) regulator has a low input-to-output voltage difference between an input terminal to which an unstable power supply voltage is applied and the output terminal of the regulator which provides the stabilised voltage. Ideally, the dropout voltage should be as low as possible, to reduce the power consumption while still maintaining regulation performance.

FIG. 1 shows a circuit diagram of a known voltage regulator described in US 2013/0076325 A1. This known LDO regulator comprises a pass transistor 101, an operational amplifier 102, and a voltage divider circuit 103. The gate of the pass transistor is coupled to the operational amplifier's output which comprises a control signal which serves to regulate a supply voltage VIN which is applied to the source of the pass transistor. A regulated voltage VOUT thus appears at an output node 104 which is coupled to the drain of the pass transistor. The operational amplifier 102 has two inputs for receiving, respectively, a reference voltage VREF and a feedback voltage VFB (which is derived from VOUT), and generates the control signal according to a difference between the reference voltage VREF and the feedback voltage VFB. The voltage divider circuit 103 comprises a string of resistors and a stabilization element connected in series between the pass transistor's drain and ground. This voltage regulator comprises a closed loop topology. The operational amplifier drives the pass transistor with more current if, for example, VFB drops below VREF (owing to a variation in load current for example). Thus the voltage at VOUT is stabilised.

Voltage regulators may also, typically, be used to power ASICs. An ASIC (Application Specific Integrated Circuit) is a semiconductor device designed for a particular application and may include virtually any collection of known digital circuits. ASICs may be powered by one of the available various regulator technologies depending upon the needs of the circuit. For example, for applications requiring extremely low quiescent and active operating current but which can tolerate the use of an external (i.e., relatively large) capacitor, a linear (e.g., low dropout (LDO)) regulator is highly suitable. On the other and, if board space (or other physical space) is at a premium and higher quiescent and active operating currents are tolerable, then a "capless" regulator having no external capacitor may be a better solution. WO 2009/085439 describes an ASIC which includes both types of regulator which may be selectable by internal control circuitry. Both types of regulator are closed loop whose stability is affected by variations in load capacitance.

Digital circuits, such as those found in ASICs for example, often have load current profiles consisting of sharp and short current spikes. Such transient digital load currents can be typically several milliAmps although average current drain is usually small and of the order of a few microAmps. Decoupling capacitors are typically employed on the power supply line of a digital load in order to minimise transient voltage drops and the propagation of switching noise. However, the stability of a closed loop regulator depends on the total output capacitance. This may include any decoupling capacitors and the capacitance of the load. This is a disadvantage because of the difficulty in predicting both the amount of decoupling required and the load capacitance of the system to which the regulator will deliver the regulated voltage.

SUMMARY OF THE INVENTION

The present invention provides a voltage regulator, application-specific integrated circuit and method for providing a load with a regulated voltage as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Figure 2:
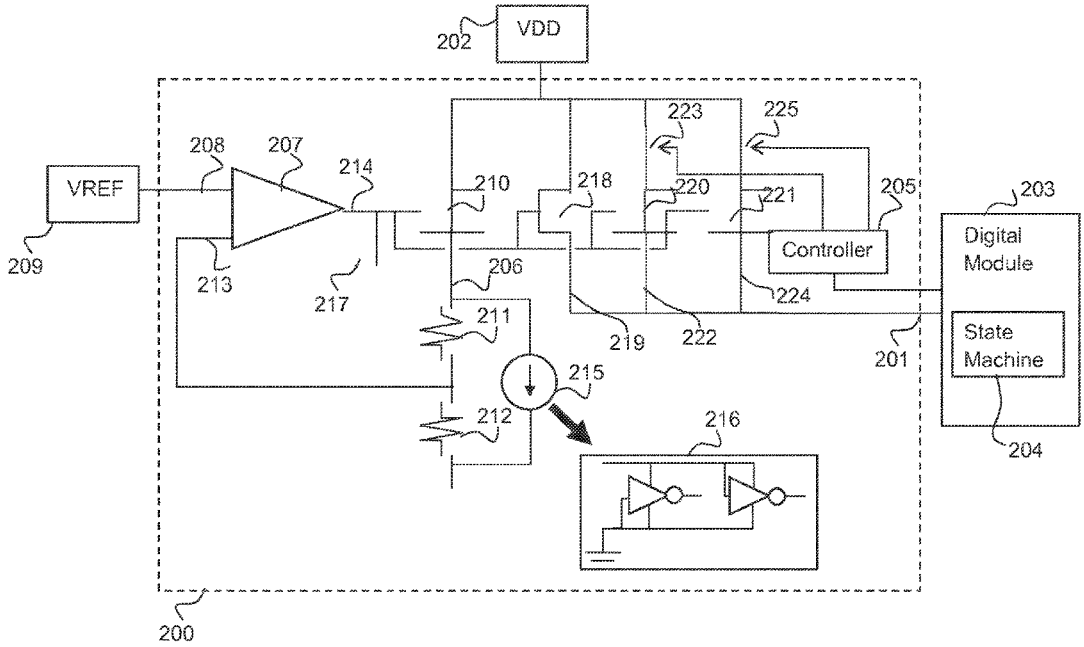
FIG. 2 is a simplified circuit diagram of an example of voltage regulator.

Referring now to FIG. 2, an example of the voltage regulator circuit 200 has an external output node 201 which may provide a regulated voltage derived from a supply voltage (VDD) 202 to an electrical load. In this example, the electrical load is a digital module 203 which may for example be an ASIC or a part of an ASIC. The digital module 203 may include a state machine 204 which may be arranged to control the operating modes and internal clock frequency of the digital module. An output of the digital module 203 may be operatively coupled to an input of a controller module 205 which comprises a part of the voltage regulator 200.

Figure 1:
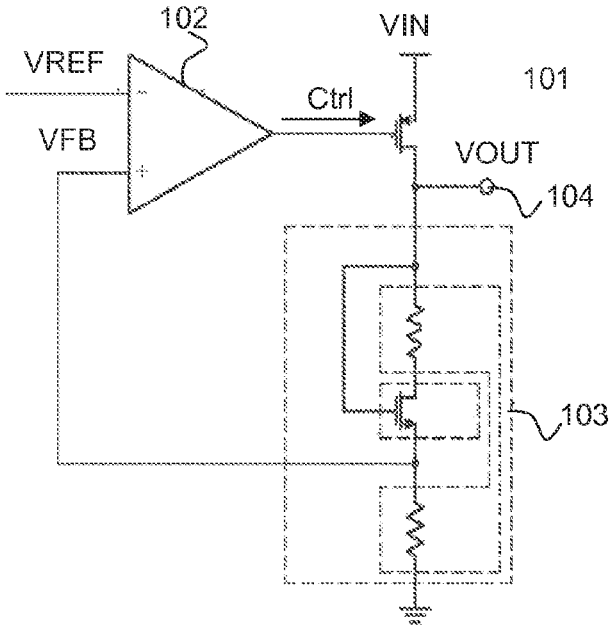
FIG. 1 is a simplified circuit diagram of an example of a known voltage regulator circuit.

The voltage regulator 200 may include a closed loop circuit arranged to produce a stabilised voltage (derived from the supply voltage VDD) at an internal output node 206. The closed loop circuit may comprise a control circuit which in this example comprises an operational amplifier 207 which may be supplied with a reference voltage (Vref) at its non-inverting input 208 by an external power source 209. In general, the control circuit may comprise any error amplifier which is capable of driving an output device with a comparatively large signal while ensuring that the difference between a reference voltage and a feedback signal remains comparatively small. The closed loop circuit may also comprise a first pass device 210. Typically, this first pass device may be a transistor such as an NMOS or a PMOS device. In this example the first pass device 210 comprises an N channel MOSFET (metal oxide silicon field effect transistor) whose drain is operably coupled to the external power supply 202 (VDD) and whose gate is operably coupled to an output of the operational amplifier 207. The closed loop circuit may also comprise a feedback circuit configured in this example as a voltage divider circuit and comprising two series resistors 211 and 212 operably coupled between the source of the first pass device 210 and ground. A feedback voltage is taken from the junction of the two series resistors 211 212 and fed to the inverting input 213 of the operational amplifier 207 where it is compared with the reference voltage. Thus, the closed loop circuit behaves in the conventional manner as described above with reference to FIG. 1 with the operational amplifier 207 providing a control signal at its output on line 214 which drives the gate of the first pass device 210 so it may maintain a stabilised voltage at the internal output node 206, (this being the source node of the first pass device).

A temperature-dependent static current load 215 may, optionally, be provided and connected across the feedback circuit comprising the resistors 211 and 212. In one example this static current load may comprise a dummy digital block 216 (shown inset in FIG. 2). This digital block 216 may be representative of changes in current with temperature as will be explained below.

Optionally, a decoupling capacitor 217, whose function will be explained below, may be provided and coupled between the output of the operational amplifier 207 and ground.

The voltage regulator 200 may also comprise an open loop circuit topology. In this example, the voltage regulator 200 is configured to have its output stage outside the feedback loop. Such a regulator advantageously has a stability which is completely insensitive to any output capacitance. The voltage appearing at the internal output node 206 may be regulated as mentioned above by a feedback loop to a desired voltage level (derived from the voltage source 202 (VDD). This internal output is not loaded by any unknown capacitance, so stabilisation of the feedback loop is easily achieved. A constant load current for the feedback loop is set by the resistor ladder of the voltage divider circuit 211, 212. A regulated voltage appearing at the regulator's external output 201 is used to supply the digital load 203 and is generated by the open loop components to be described below.

The voltage regulator 200 may also comprise a second pass device 218. This second pass device 218 may be sized to match a load current which is predicted to be required by the load 203. This second pass device 218 may be arranged to generate a regulated voltage (derived from VDD) at the output node 201 according to the control signal generated by the operational amplifier 207. In the exemplary embodiment of FIG. 2, the second pass device may be an N channel MOSFET whose drain is operably coupled to the voltage supply 202, VDD, and whose gate receives the same control signal as does the gate of the first pass device 210, that is, the output of the operational amplifier 207. A source node 219 of the second pass device 218 may be operably coupled to the external output node 201 of the regulator. The use of an N channel MOSFET (as opposed to a P-channel device) provides a lower output impedance. A DC voltage level appearing at the external output 201 may be ensured by matching the first and second pass devices 210, 218. For example, if the internal output node 206 is loaded with 500 nA and the expected average load current for the digital module 203 is 5 μA, then the second pass device 218 needs to be 10 times larger than the first pass device 210 to yield approximately the same output voltage.

The open loop topology of the voltage regulator 200 may further comprise additional pass devices, controlled by the control signal which is generated at the output of the operational amplifier 207, and which are arranged to generate a stabilised value of VDD. In the example of FIG. 2, third and fourth pass devices 220, 221 respectively also comprise N channel MOSFETs which provide a comparatively low output impedance. A gate of the third pass device 220 may receive the control signal on line 214. A source node 222 of the third pass device 220 may be operably coupled to the external output node 201. A drain of the third pass device may be operably coupled to the supply voltage 202 (VDD) via a first switch 223. A gate of the fourth pass device 221 may receive the control signal on line 214. A source node 224 of the fourth pass device 221 may be operably coupled to the external output node 201. A drain of the fourth pass device 221 may be operably coupled to the supply voltage 202 (VDD) via a second switch 225. Hence, gate voltage is the same for all of the output devices (that is the second third and fourth pass devices 218, 220, 221) the gate voltage being set by the closed loop circuit which includes the operational amplifier 207 and the first pass device 210. The switches 223, 225 may be operably coupled to and controlled by the controller 205. The controller 205 in turn, may be controlled by a signal generated by the digital module 203 which notifies the controller 205 of an imminent change in current load requirement. In response to this notification signal the controller may be arranged to switch in or out either one or both of the third or fourth pass devices 220, 221.

In one embodiment, the output stage of the regulator 200 (the second, third and fourth pass devices 218, 220, 221,) may be a source follower (common drain stage) in order to provide a low impedance output. The first pass device 210 may also be a source follower.

In one embodiment, the voltage threshold of the second third and fourth pass devices comprising N channel MOSFETs may have threshold voltages substantially equal to zero volts in order to provide a low dropout operation. The voltage threshold of the first pass device 210 may also be substantially equal to zero volts.

Typically, the electrical characteristics of the first, second, third and fourth pass devices will vary in a similar fashion in response to manufacturing process variations or to ambient temperature changes. Advantageously, this ensures a constant output voltage at the regulators output 201 to first order.

The voltage regulator 200 may be implemented in an integrated circuit device. In another embodiment, the voltage regulator 200 may be implemented within the digital module and an example of the invention may provide an ASIC having an on-board voltage regulator 200. Such an ASIC may be arranged to generate a signal which notifies the voltage regulator that a change in load current requirement is imminent.

In operation of the example of FIG. 2, the number of pass devices used in the (open loop) output stages of the voltage regulator is varied (by opening or closing either or both of the switches 223, 225) depending on the estimated current requirements of the digital module 203. The estimation of load current requirements (or average current consumption) may be performed in the digital module itself by utilising the state machine 204. The state machine may be arranged to anticipate an imminent change of current consumption of the digital module if it knows the relevant system parameters such as the various operating modes of the digital module and its clock frequency. For example, some operating modes may require a higher current than others and a clock running at a high frequency may typically take more current than one running at a lower frequency.

In one example, say that the standby current requirement of the digital module 203 is 1 μA (this is typical for a small digital module), a low-power mode of the digital module 203 has a current requirement of 20 μA and a high-power mode of the digital module 203 has a current requirement of 50 μA. In this example, the second pass device is defined to have a size of one unit. That is to say that the second pass device 218 is a one unit device. The third pass device 220 has a size of 19 unit devices. The fourth pass device 221 has a size of 30 unit devices. The pass devices may be sized by gate widths for example, with the larger gate width supplying the larger drain current. Hence, the second pass device 218 can supply a load current of 1 μA, the third pass device 220 can supply a load current of 19 μA and the fourth pass device 221 can supply a current of 30 μA. Various combinations of the second third and fourth pass devices 218, 220, 221 may be switched in and out by the switches 223, 225 under the control of the controller module 205 in response to a signal by the digital module 203. Thereby, different load currents may be supplied to the digital module 203 but with the voltage at the output 201 being maintained at the same regulated value. In this example a low-power mode requirement of 20 μA may be met by switching in the third pass device 220. Therefore, with 1 μA being provided by the second pass device 218 and 19 μA being provided by the third pass device 220, the requirement of 20 μA is satisfied. The high-power mode requirement of 50 μA may be satisfied by switching in both third and fourth pass devices 220, 221. In this way, the fourth pass device 221 supplies 30 μA, the third pass device 220 supplies 19 μA and the second pass device 218 supplies 1 μA.

Hence the voltage regulator 200, by matching size and current between output devices 218, 220, 221 (in open loop) and a reference device 210 (in closed loop) ensures that the open loop output node 201 has the same voltage as appears at the internal closed loop output node 206. Hence constant output voltage can be obtained when pass device sizes are adapted to an estimated load current. Furthermore, the voltage regulator 200 may yield a constant output voltage whatever the operating load of the digital module 203 together with an unconditional stability regardless of the amount of any decoupling capacitance present.

Variations in the output voltage of the voltage regulator 200 are kept to a minimum because the number of unit devices which conduct the load current is made proportional to the average load current (that is, there is a constant current density). Sizing the pass devices in this way ensures that the gate-to-source voltage of each pass device is the same.

In order to reduce the effects of any switching noise which might be generated when either of the switches 223, 225 are opened or closed, a capacitor 217 may, optionally, be operably coupled between the output of the operational amplifier 207 and ground. This measure can also improve the stability of the feedback loop (which includes the operational amplifier 207 and the first pass device 210) because the dominant pole frequency is pushed down to a lower frequency. The value of this capacitor 217 may typically range from a few pF to a few tens of pF Typically, dynamic current of the digital module 203 has little temperature dependence whereas static current leakage has a strong temperature dependence. Optionally, the voltage regulator 200 may be adapted to tolerate high levels of sub-threshold leakage. To this end, a temperature-dependent static current load 215 may be provided and operably coupled in parallel across the series resistors 211 212. In one example, such a static current load may comprise dummy logic 216. This dummy logic may comprise a plurality of conventional logic cells that are not driven by any dynamic signal. They may be purely static so that they only consume DC leakage. In this way, a temperature-dependent current which is proportional to any leakage sunk by the digital module 203 will flow in the first pass device 210. The amount of dummy logic selected may be N times smaller than the size of the logic module if the total size of the open loop pass devices 218, 220, 221 is N times larger than the size of the first pass device 210 of the closed loop. In general, any means which may generate a static load current for the first pass transistor 210 which has the same temperature dependence as the digital module 203 may be employed. Any dependence of leakage on logic transistor threshold voltage variation in the digital module 203 may also be addressed using dummy logic gates.

Figure 3:
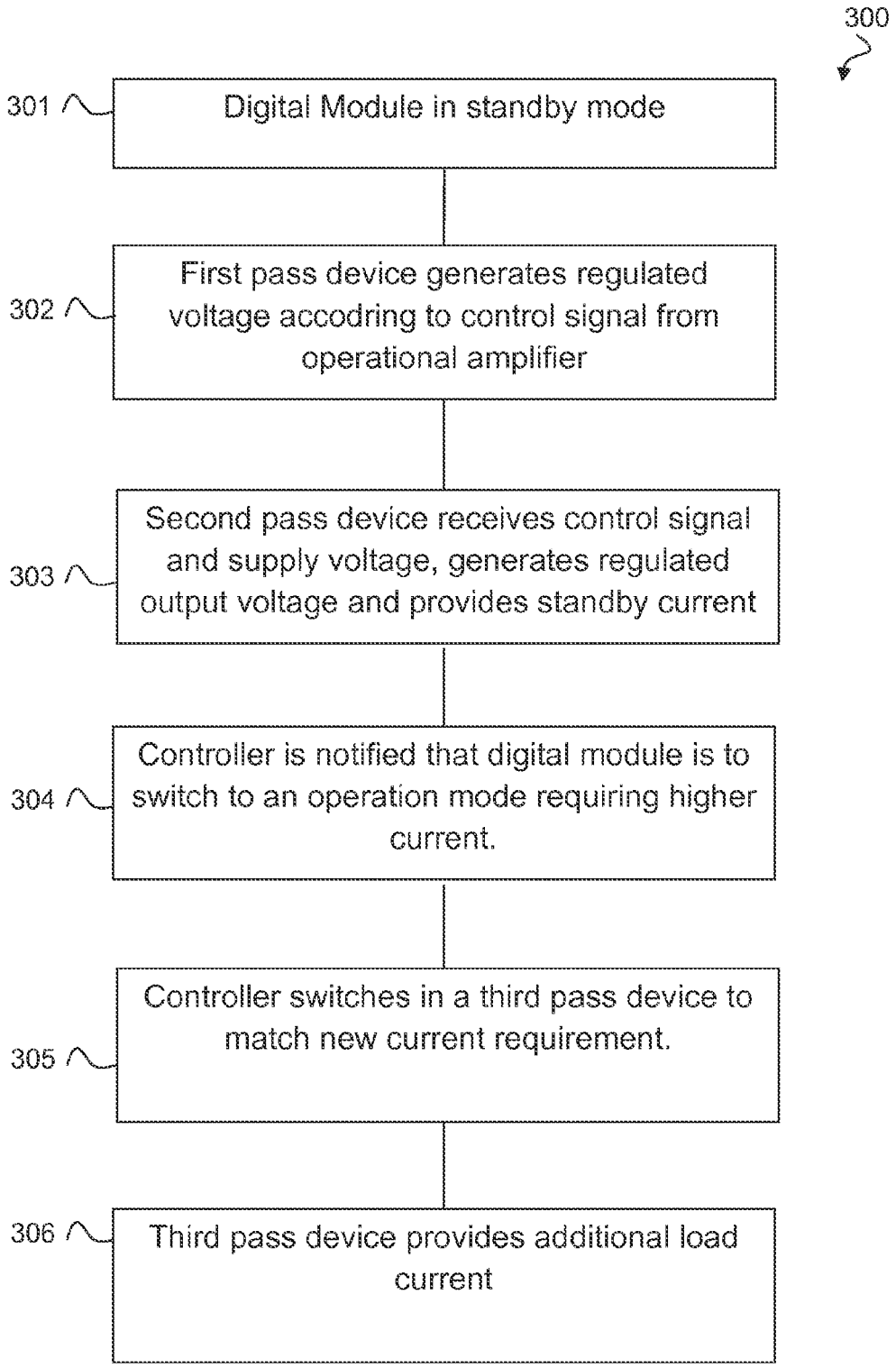
FIG. 3 is a simplified flowchart of an example of a method for providing a regulated voltage.

Reference will now be made to FIG. 3 which is a simplified flowchart of an example of a method 300 for providing a load, such as the digital module 203, of FIG. 2 with a regulated voltage.

At 301, the digital module 203 is set in standby mode and the switches 223 and 225 of the regulator 200 are open. With reference to FIG. 2, the digital module 203 may send a signal to the controller 205 indicating that the digital module is in standby mode and in response to this signal, the controller 205 may ensure that both switches 223 and 225 are open.

Referring again to FIG. 3, at 302, the operational amplifier generates a control signal on its output line 214 which is applied to the gate of the first pass device 210 which generates a regulated voltage accordingly at its output node 206.

At 303 the second pass transistor 218 also receives the control signal from the operational amplifier 207 and generates a regulated voltage at the output 201 of the regulator and provides standby load current of 1 μA to the digital module 203.

At 304, the controller 305 is notified by the digital module 203 that the digital module is about to switch to an operational mode which requires a higher current than standby mode.

At 305 the controller activates one of the switches 223, 225 so that one of the third or fourth pass devices 220, 221 may be switched in, in order to match the additional current requirement.

At 306, with the switch 223 closed, for example, the third pass device 220 is then connected with the power supply 202 and also receives the control signal at its gate on line 214 from the operational amplifier 207. Consequently the third pass device 220 is able to provide the additional load current and the output 201 of the voltage regulator is maintained at the regulated voltage level.

In one embodiment, a voltage regulator may provide a regulated output voltage and load current based on a reasonably accurate prediction of the average load current of the open loop devices. This prediction may be obtained by simulation with digital design tools. If this is not possible due to tool deficiency or unavailability, alternative embodiments may be employed to restore the expected open loop output voltage in case of an average load current much different from the expected value.

One embodiment may involve trimming of a ratio between the internal (closed loop) output device and the external (open loop) output devices. A ratio may, for example, be the ratio between a size of the first pass device 210 and the size of the second pass device 218. Say for example that the second pass device 218 is arranged to provide the load current when the digital module 203 is in standby mode but a prediction of 1 uA standby current may not have been accurate. In this example, the second pass device 218 may comprise a plurality of parallel devices which may be identical, that is, having the same gate width and length for example. One of the plurality of parallel devices may be permanently connected but the remaining devices may be controlled by series switches between their drain terminals and the supply VDD 202. If, by monitoring the voltage at the external output node 201, it is observed to be lower than a desired voltage (because the actual standby current is larger than 1 uA), then one or more of the remaining pass devices may be switched in until the voltage is restored to its desired value. For example, using three identical pass devices in this manner can permit restoration of the voltage at the external output node 201 closer to its desired value even if the actual standby current is as large as 3 uA. The control signals for the series switches may be controlled by the digital module 203. If, for example, a final test for an ASIC (including the digital module 203) involves trimming the regulator (open-loop) output voltage, this voltage may be measured by a conventional tester unit through a test mode. Control signals for the series switches may be enabled or disabled via an appropriate and conventional logic interface (I2C or SPI for example) of the digital module 203 so that the output voltage of the regulator 200 is trimmed as close as possible to the desired value. The state of a controlling signal for the series switches may then be stored in a permanent memory (fuses or EEPROM for example) which may be embedded in the digital module 203. Then, at each power-up of the ASIC in the field, the memory may be read in order to restore the proper configuration and therefore the correct setting for the series switches.

Alternatively one embodiment may involve trimming of the resistance of the feedback circuit (voltage divider) that sets the bias current for the first pass device 210 and hence the load current for the internal output node 206. Say, for example, that the actual standby current that must be provided by the second pass device 218 is 2 uA whereas only 1 uA was predicted when the regulator was designed and that the feedback circuit 211, 212 was designed to provide a bias current of 1 uA. (This means that first and second pass devices 210 and 218 were sized identically since the load current of the second pass device 218 was predicted to be 1 uA). Due to the mismatch in their currents (2 uA for the second pass device 218, and 1 uA for the first pas device 210) and their identical sizes, a delta VGS exists between the two pass devices 210 and 218, which causes a voltage error at the regulator's output 201 since the closed-loop output regulation is ensured by the feedback loop. However, if the resistive divider that creates the load current for the first pass device 210 is altered so that this load current now becomes 2 uA, then the delta VGS will disappear and the regulator's output voltage may be restored to the desired value because the control signal on line 214 will be raised by the action of the feedback loop. Changing the resistance values in the resistive divider without changing the divider ratio may be done in several ways. To decrease the values of the resistors 211 and 212 (which would increase bias current for the first pass device 210), additional resistors can be added in parallel to each of the resistors 211 and 212. Alternatively, if the resistors 211 and 212 comprise an arrangement of unit resistors in series, some of these resistors may be short-circuited by a switch in order to decrease the total resistance. In some cases, increasing the values of the resistors 211 and 212 (to decrease the bias current for the first pass device 210, which may be needed if the prediction of standby current was too high) may be done either by switching out parallel resistors, or switching in additional series resistors to both resistors 211 and 212. Control of any switches included in the resistive divider circuit may be configured by the digital module 203 based on the content of permanent memory read on start-up and programmed during trimming at final test.

The regulator's (open loop) output may be observed using conventional circuitry in order to check its level against the expected value during a final test This may be done using an analog test multiplexer connected to a pin of the product which may be configured as an analog test pin during final test.

In the foregoing specification, the invention has been described with reference to specific examples of embodiments of the invention. It will, however, be evident that various modifications and changes may be made therein without departing from the broader spirit and scope of the invention as set forth in the appended claims. For example it will be appreciated that the NMOS devices of the voltage regulator 200 may be replaced with PMOS devices provided that the appropriate polarities and interconnections are adjusted. Further, while the example embodiments have been described in the context of regulating a voltage for a digital load, the invention is not restricted to a load of this type and may, alternatively, be employed for providing a regulated voltage to an analog load.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Although specific conductivity types or polarity of potentials have been described in the examples, it will appreciated that conductivity types and polarities of potentials may be reversed.

Each signal described herein may be designed as positive or negative logic. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals.

Furthermore, the terms "assert" or "set" and "negate" (or "deassert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Those skilled in the art will recognize that the boundaries between logic blocks and circuit elements are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. The voltage regulator 200 of FIG. 2 may be implemented in a single integrated circuit device. Alternatively, the digital module 203 (which may be an ASIC) of FIG. 2 may include the voltage regulator 200, both devices 200, 203 being included in a single integrated circuit device. An integrated circuit may be a package containing one or more dies. An integrated circuit device may comprise one or more dies in a single package with electronic components provided on the dies that form the modules and which are connectable to other components outside the package through suitable connections such as pins of the package and bondwires between the pins and the dies. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements The mere fact that certain measures are recited in mutually different claims does not indicate that a combination of these measures cannot be used to advantage.

The invention claimed is:

1. A voltage regulator to provide an output regulated voltage to a load, the voltage regulator comprising:

a regulator output, a first pass device arranged to receive a supply voltage and to generate an internal regulated voltage according to a control signal, a control circuit arranged to generate the control signal according to a feedback voltage, a feedback circuit to generate the feedback voltage according to the internal regulated voltage, a second pass device having an output node which is operably coupled to the regulator output and being sized to match a first predicted load current requirement, the and arranged to receive said supply voltage and said control signal and to generate the output regulated voltage at the regulator output according to said control signal for application to the load;

a first switch coupled to the supply voltage;

a controller to provide a control signal to the first switch, the controller to open and close the first switch based on a change in a current load requirement; and a third pass device coupled to the first switch, the third pass device having an output node which is operably coupled to the regulator output and being sized to match a different predicted load current requirement, the third pass device to receive the control signal and to receive, via a respective switch, the supply voltage, and to generate the output regulated voltage at the regulator output according to said control signal for application to the load.

2. The voltage regulator of claim 1 comprising:

one or more further switches and one or more further pass devices each having an output node which is operably coupled to the regulator output and being sized to match different predicted load current requirements and each being arranged to receive the control signal and to receive, via a respective switch, the supply voltage, wherein said switches are opened and closed by the controller and wherein each one or more further pass devices are arranged to generate the output regulated voltage at the regulator output according to said control signal for application to the load.

3. The voltage regulator of claim 1 wherein at least one of the pass devices comprises an N channel MOSFET (metal oxide field effect transistor).

4. The voltage regulator of claim 3 wherein a threshold voltage of the at least one of the pass devices comprising an N channel MOSFET is substantially zero.

5. The voltage regulator of claim 3 wherein the first, second and further pass devices comprising N channel MOSFETs are configured as a source followers.

6. The voltage regulator of claim 1 wherein the pass devices are sized by gate width.

7. The voltage regulator of claim 2 wherein a third pass device has a greater width than the second pass device.

8. The voltage regulator of claim 2 wherein the second pass device comprises 1 unit device and a third pass device comprises N unit devices where N is an integer greater than 1.

9. The voltage regulator of claim 1 comprising a temperature-dependent static current load operably coupled between an output node of the first pass device and ground.

10. The voltage regulator of claim 1 wherein the voltage regulator is implemented in an integrated circuit device.

11. A method for providing a load with a regulated voltage, the method comprising:

receiving at a first pass device a supply voltage and a control signal, generating, at the first pass device, a first regulated voltage according to the control signal wherein the control signal is derived from an output of the first pass device, and receiving at a second pass device which is sized to match a first predicted load current requirement, said supply voltage and said control signal, and at the second pass device, generating a regulated output voltage according to said control signal and applying the regulated output voltage to an output of the regulator, receiving, at a controller, a signal indicative of an imminent additional requirement in load current;

closing a switch in response to the signal;

connecting a third pass device, sized to match the additional load current requirement, between the supply voltage and the output of the regulator in response to closing the switch; and controlling the third pass device with said control signal.

12. The method of claim 11 further comprising connecting a third pass device between the supply voltage and the output of the regulator to match a desired value of the regulated output voltage.

13. The method of claim 11 further comprising trimming a value of a feedback circuit which controls the first pass device to match a desired value of the regulated output voltage.

14. An integrated circuit device comprising:

a voltage regulator comprising:

a regulator output, a first pass device arranged to receive a supply voltage and to generate an internal regulated voltage according to a control signal, a control circuit arranged to generate the control signal according to a feedback voltage, a feedback circuit for generating the feedback voltage according to the internal regulated voltage, a second pass device having an output node which is operably coupled to the regulator output and being sized to match a first predicted load current requirement and arranged to receive said supply voltage and said control signal and to generate an output regulated voltage at the regulator output according to said control signal for application to the load;

a first switch coupled to the supply voltage;

a controller to provide a control signal to the first switch, the controller to open and close the first switch based on a change in a current load requirement; and a third pass device coupled to the first switch, the third pass device having an output node which is operably coupled to the regulator output and being sized to match a different predicted load current requirement, the third pass device to receive the control signal and to receive, via a respective switch, the supply voltage, and to generate the output regulated voltage at the regulator output according to said control signal for application to the load an Application Specific Integrated Circuit arranged to generate a notification signal for application to the voltage regulator, said signal being indicative of a current requirement.

15. The integrated circuit device of claim 14, wherein the voltage regulator further comprises:

a controller;

one or more switches and one or more further pass devices each having an output node which is operably coupled to the regulator output and being sized to match different predicted load current requirements and each being arranged to receive the control signal and to receive, via a respective switch, the supply voltage, wherein said switches are opened and closed by the controller and wherein each one or more further pass devices are arranged to generate a regulated voltage at the regulator output according to said control signal for application to the load.

16. The integrated circuit device of claim 14, wherein at least one of the pass devices comprises an N channel MOSFET (metal oxide field effect transistor).

17. The integrated circuit device of claim 16 wherein the threshold voltage of at least one or the pass devices comprising an N channel MOSFET is substantially zero.

18. The integrated circuit device of claim 16 wherein the first, second and further pass devices comprising N channel MOSFETs are configured as a source followers.

* * * * *